US007428392B2

(12) United States Patent
Yamashita

(10) Patent No.: US 7,428,392 B2
(45) Date of Patent: Sep. 23, 2008

(54) IMAGE FORMING APPARATUS, PROCESS CARTRIDGE AND CHARGER HAVING A CLEANING MEMBER

(75) Inventor: Toshimi Yamashita, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 294 days.

(21) Appl. No.: 11/288,317

(22) Filed: Nov. 29, 2005

(65) Prior Publication Data

US 2006/0127123 A1 Jun. 15, 2006

(30) Foreign Application Priority Data

Dec. 9, 2004 (JP) ..... 2004-356206

(51) Int. Cl.
*G03G 15/02* (2006.01)

(52) U.S. Cl. ..... 399/100

(58) Field of Classification Search ..... 399/100, 399/170, 173; 361/225, 229, 230; 250/324–326
See application file for complete search history.

(56) References Cited

U.S. PATENT DOCUMENTS 5,532,798 A * 7/1996 Nakagami et al. ..... 399/170
5,845,179 A * 12/1998 Damji et al. ..... 399/173
6,640,065 B1 * 10/2003 Yuge ..... 399/100
7,003,243 B2 * 2/2006 Yamashita ..... 399/100
7,277,656 B2 * 10/2007 Nakayama ..... 399/100
2005/0207778 A1 9/2005 Yamashita

FOREIGN PATENT DOCUMENTS

JP 02048684 A * 2/1990
JP 06317977 A * 11/1994
JP 09-211940 A 8/1997

* cited by examiner

*Primary Examiner*—Robert Beatty
(74) *Attorney, Agent, or Firm*—Foley & Lardner LLP

(57) ABSTRACT

Dust collection portions are installed at both ends of a holding plate installed on a shield plate of a charger. On the other hand, in a cleaning device, a dust collection member is installed so as to make contact with the shield plate and holding plate. Dust such as discharge products and toner occurred when moving the cleaning device and cleaning a sawtooth discharge electrode falls on the side of the charger where the holding plate of the shield plate is installed. The cleaning device, since the dust collection member is installed, cleans the sawtooth discharge electrode, simultaneously collects dust such as discharge products and toner on the shield plate by the dust collection member, and can collect dust in the dust collecting portions installed at both ends of the holding plate. By doing this, the grid can be prevented from adhering of dust and the print quality is prevented from lowering.

12 Claims, 5 Drawing Sheets

IMAGE FORMING APPARATUS, PROCESS CARTRIDGE AND CHARGER HAVING A CLEANING MEMBER

CROSS-REFERENCE TO RELATED APPLICATION

This application is based upon and claims the benefit of priority from the prior Japanese Application Publicaiton No. 2004-356206, filed on Dec. 9, 2004, the entire contents of all of which are incorporated herein by reference.

FIELD OF THE INVENTION

The present invention relates to an image forming apparatus, a process cartridge, and a charger and more particularly to an image forming apparatus wherein a cleaning device for a discharge electrode is improved, a process cartridge, and a charger.

DESCRIPTION OF THE BACKGROUND

Conventionally, a charger of a corona discharge method of an image forming apparatus such as a copier or a printer is broadly divided into a wire discharge method (Corotron charger, Scorotron charger, etc.) and a pin discharge method (pin electrode, sawtooth discharge electrode, etc.). As a cleaning means for cleaning these discharge electrodes, for a wire electrode of the wire discharge method, a cleaning method for wrapping a wire with a cleaning member such as felt and moving the cleaning member in the longitudinal direction of the charger is general.

With respect to the pin discharge method, particularly the cleaning method for a sawtooth discharge electrode, as disclosed in Japanese Patent Application Publication No. 9-211940, a cleaning method for moving a cylindrical cleaning member along the sawtooth discharge electrode and press-fitting the cylindrical cleaning member into the front end of the sawtooth discharge electrode is known.

In the cleaning member by rolling contact of the roller disclosed in Japanese Patent Application Publication No. 9-211940, discharge products, toner, and dust are removed from the front end of the saw teeth. However, the removed discharge products, toner, and dust are not only adhered to the cleaning roller but also may fall inside the plate covering the discharge electrode. The discharge products, toner, and dust fallen inside the plate, hereafter, are adhered to the grid for controlling discharge from the discharge electrode by a wind in the main body of the image forming apparatus, thus a faulty image may be obtained.

SUMMARY OF THE INVENTION

The present invention was developed to solve the aforementioned problem and is intended to provide an image forming apparatus for collecting dust removed by cleaning a discharge electrode, thereby preventing the removed dust from splashing out again, a process cartridge, and a charger.

To accomplish the above object, according to the embodiment of the present invention, there is provided an image forming apparatus comprising: a photosensitive member; a charger to charge a surface of the photosensitive member; an exposure to expose the surface of the photosensitive member charged by the charger, thereby form an electrostatic latent image; and an image forming unit to develop the electrostatic latent image and transfer the developed image, thereby form an image on a medium, wherein the charger includes: a discharge electrode arranged in a longitudinal direction of the photosensitive member; a shield plate having an opening portion on the surface side of the photosensitive member to cover the discharge electrode; a cleaning device to move inside the shield plate in a longitudinal direction of the discharge electrode, thereby removes dust from the discharge electrode; and a dust collecting portion to collect the dust.

Further, according to the embodiment of the present invention, there is provided a process cartridge removably attached to a main body of an image forming apparatus, comprising: a photosensitive member; and a charger to charge a surface of the photosensitive member, wherein the charger includes: a discharge electrode arranged in a longitudinal direction of the photosensitive member; a shield plate having an opening portion on the surface side of the photosensitive member to covering the discharge electrode; a cleaning device to move inside the shield plate in a longitudinal direction of the discharge electrode, thereby removes dust from the discharge electrode; and a dust collecting portion to collect the dust.

Furthermore, according to the embodiment of the present invention, there is provided a charger comprising: a discharge electrode arranged in a longitudinal direction of a photosensitive member; a shield plate having an opening portion on a surface side of the photosensitive member to cover the discharge electrode; a cleaning device to move inside the shield plate in a longitudinal direction of the discharge electrode, thereby removes dust from the discharge electrode; and a dust collecting portion to collect the dust.

DETAILED DESCRIPTION OF THE INVENTION

Hereinafter, the embodiments of the present invention will be explained with reference to the accompanying drawings. However, the dimensions, materials, and shapes of the components described in the embodiments, unless otherwise specified, do not restrict the scope of the present invention.

Embodiment 1

Figure 1:
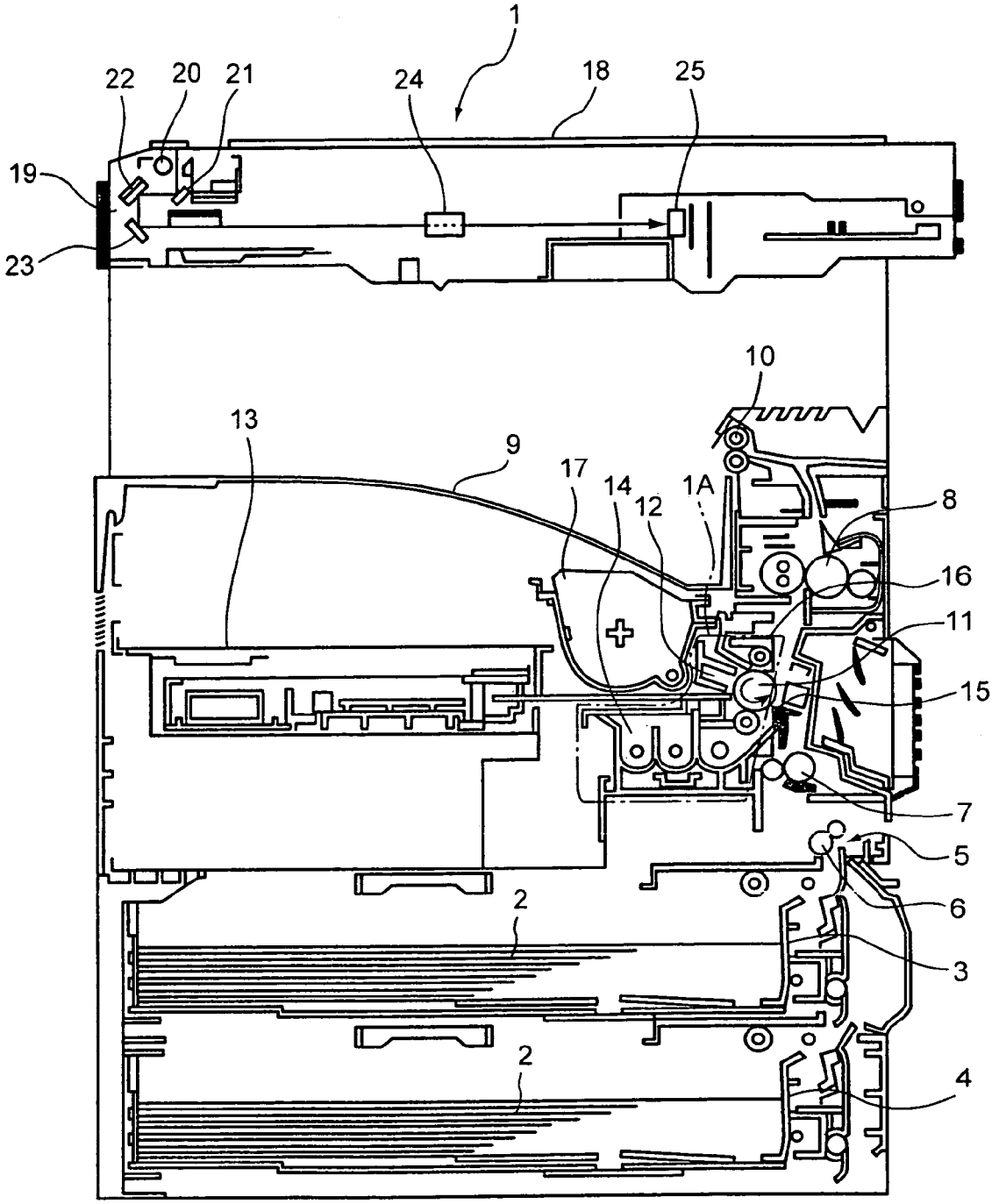
FIG. 1 is an inner block diagram showing the main body of the image forming apparatus which is an embodiment of the present invention.

FIG. 1 is an inner block diagram showing the main body of the image forming apparatus which is an embodiment of the present invention. Under main body 1 of the image forming apparatus, a plurality of steps of paper supply cassettes 3 and 4 storing recording media 2 are installed. Recording media 2 are conveyed upward via conveying route 5. In conveying path 5, conveying rollers 6 for conveying recording media 2 up to process cartridge 1A, aligning rollers 7, fixing device 8, and exit rollers 10 for discharging image-recorded recording media 2 to paper receiving tray 9 are arranged.

In the middle in main body 1, process cartridge 1A is removably attached to main body 1. Process cartridge 1A has photosensitive drum 11 as a photosensitive member attached rotatably. Around photosensitive drum 11, in the direction of the arrow (counterclockwise), charger 12 of the corona discharge method, exposure 13, developing device 14, transferring device 15, and cleaning device are arranged. Above developing device 14, toner supply device 17 is installed.

Above main body 1, document table 18 is installed. Under document table 18, scanner 19 for reading a document on document table 18 is installed. Scanner 19 includes light source 20 for irradiating light to the document, first mirror 21 for reflecting the light reflected from the document in a predetermined direction, second and third mirrors 22 and 23 sequentially reflecting the light reflected from first mirror 21, condenser lens 24 for focusing the reflected light from third mirror 23 on the focusing face of light-sensitive element 25, and light-sensitive element 25 for receiving the light focused by condenser lens 24.

The operation of each device when an image is formed will be explained below. Firstly, when reading a document put on document table 18, light is irradiated to the document from light source 20. The light is reflected from the document and is received by light-sensitive element 25 via first mirror, 21, second mirror 22, and third mirror 23, and the document image is read. First mirror 21 moves in the longitudinal direction of the document under light source 20 shown in FIG. 1 by a drive means not drawn and reads the document. At this time, to keep the optical path length, which is a distance between the document and the focusing face of light-sensitive element 25, unchanged, second mirror 22 and third mirror 23 also move. On the basis of this read information, a laser beam is irradiated to photosensitive drum 11 from exposure 13. The surface of photosensitive drum 11 is uniformly charged by charger 12. The laser beam modulated in intensity by the image information is irradiated from exposure 13, thus an electrostatic latent image having a left charge of the image to be copied onto photosensitive drum 11 is formed. Toner charged at inverse polarity of the polarity of the electrostatic latent image is supplied from developing device 14 and the toner is adhered to the electrostatic latent image on photosensitive drum 11 to form a toner image. The toner image is superimposed on recording medium 2 conveyed from the underneath of process cartridge 1A and arranged by aligning rollers 7, and a charge at inverse polarity of the charged polarity of the toner is given to recording medium 2 by transferring device 15 from the back of recording medium 2, and the toner image is transferred onto recording medium 2 by the electrostatic force. Recording medium 2 with the toner image transferred to is conveyed to fixing device 8 and is heated or pressurized by fixing device 8 and the toner image is fixed on recording medium 2. Recording medium 2 finishing image forming is discharged to receiving tray 9 via exit rollers 10. On the other hand, the residual toner remaining on photosensitive drum 11 without being transferred is removed by drum cleaning device 16.

Figure 2:
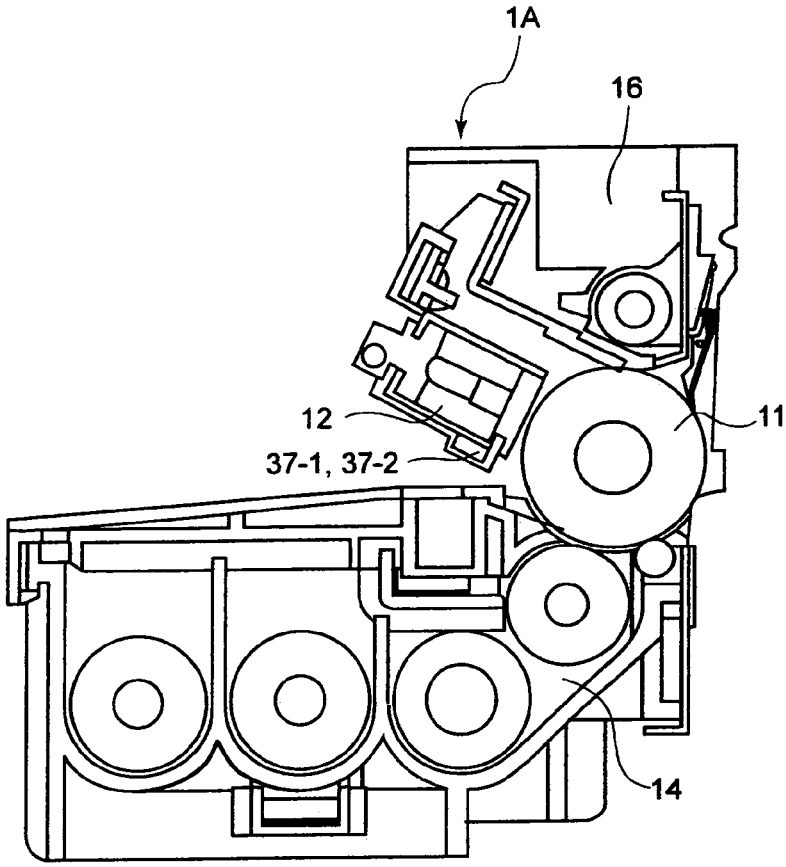
FIG. 2 is a cross sectional view of the process cartridge.
Figure 3:
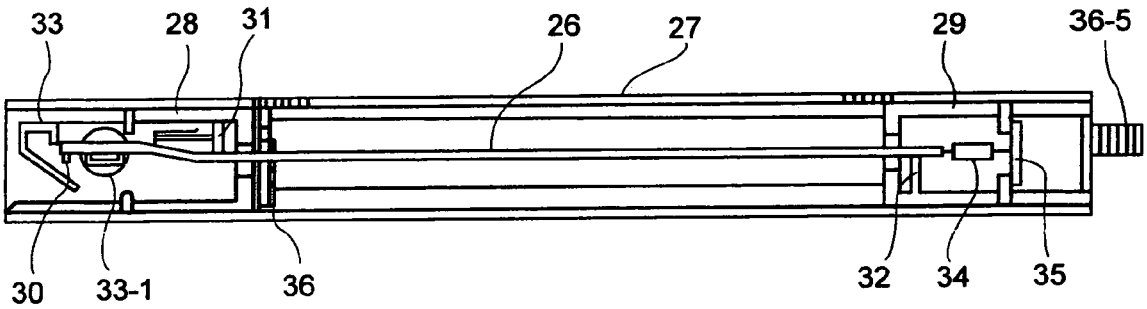
FIG. 3 is a bottom diagram showing the charger.
Figure 4:
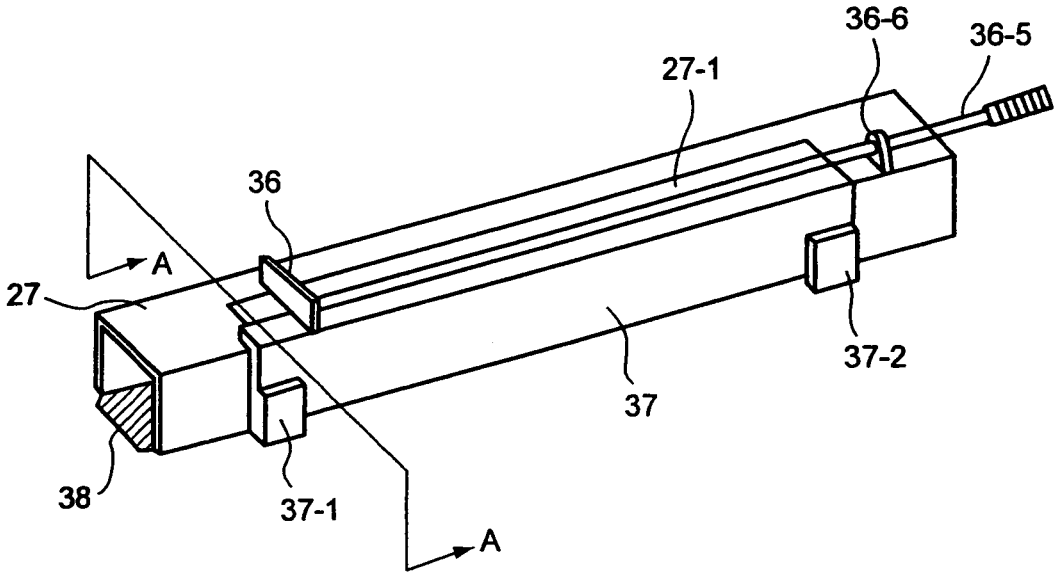
FIG. 4 is a perspective view showing the charge.

Next, charger 12 in process cartridge 1A will be explained in detail. FIG. 2 is a cross sectional view of process cartridge 1A. Process cartridge 1A is composed of photosensitive drum 11, charger 12, developing device 14, and drum cleaning device 16. Process cartridge 1A is removably attached to main body 1 of the image forming apparatus. Charger 12, as shown in FIG. 2, is installed with a slight gradient to photosensitive drum 11 instead of perpendicularly to it. FIGS. 3 and 4 show the constitution of the charger and the discharge electrode, as an example, adopts a sawtooth electrode. FIG. 3 is a drawing of the charger viewed from the side of photosensitive drum 11 and FIG. 4 is a perspective view of the charger viewed from the opposite side of photosensitive drum 11. As shown in FIGS. 3 and 4, sawtooth discharge electrode 26 is covered with shield plate 27 with a U-shaped section and the opening portion of shield plate 27 faces on the side of photosensitive drum 11. On the opposite face of shield plate 27 to the opening portion, opening portion 27-1 is formed. At both ends of shield plate 27, insulating support members 28 and 29 are fixed by screws. On support members 28 and 29, projections 30, 31, and 32 are installed to position sawtooth discharge electrode 26. On one side of sawtooth discharge electrode 26, a hole for positioning in the longitudinal direction is made and the hole and projection 30 of support member 28 are fit to each other. Furthermore, in pinch portion 33-1 of elastic electric supply plate 33 installed on support member 28, sawtooth discharge electrode 26 is pinched. On the other hand, at the opposite end of sawtooth discharge electrode 26, elastic member 34 is installed and it is pulled by fixing plate 35 and is fixed to support member 29. Into rectangular opening portion 27-1 of shield plate 27, charger cleaning device 36 for cleaning sawtooth discharge electrode 26 is inserted. Shield plate 27 includes a holding plate 37 for storing garbage such as discharge products, toner, and dust which are collected by charger cleaning device 36 (these are all referred to as dust) and restricting the discharge area from sawtooth discharge electrode 26. At both ends of holding plate 37, dust collecting portions 37-1 and 37-2 for storing dust are installed. Furthermore, on the opening portion side of shielding plate 27 facing on photosensitive drum 11, grid 38 for controlling discharge from sawtooth discharge electrode 26 is installed. Grid 38 is formed, for example, by etching a stainless steel plate with a thickness of 0.1 mm.

Figure 5:
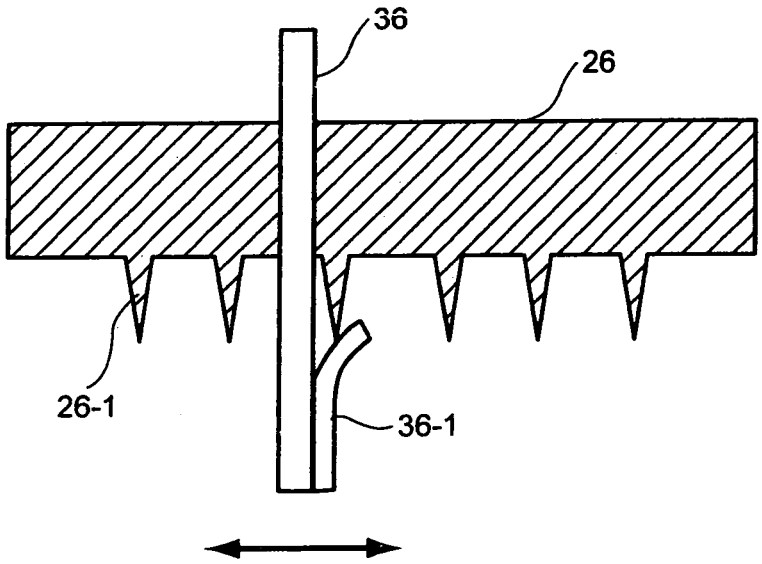
FIG. 5 is a schematic view showing the cleaning operation of the discharge electrode.

Here, sawtooth discharge electrode 26 which is an embodiment will be explained by referring to FIG. 5. Sawtooth discharge electrode 26 for charging photosensitive drum 11 is an electrode plate for corona discharge having a plurality of sawtooth discharge portions 26-1 at its front end at a fixed pitch. The electrode plate is formed, for example, by etching a stainless steel plate with a thickness of 0.1 mm or so. In sawtooth discharge portions 26-1, the curvature is, for example, R=30 μm, and the sawtooth height is 2 mm, and the pitch is 2 mm. Sawtooth discharge electrode 26 is installed opposite to the surface of photosensitive drum 11 at a fixed gap. The gap between sawtooth discharge electrode 26 and shield plate 27 is set to 7 mm or more and no-leakage of the current to shield plate 27 is taken into consideration.

Figure 6:
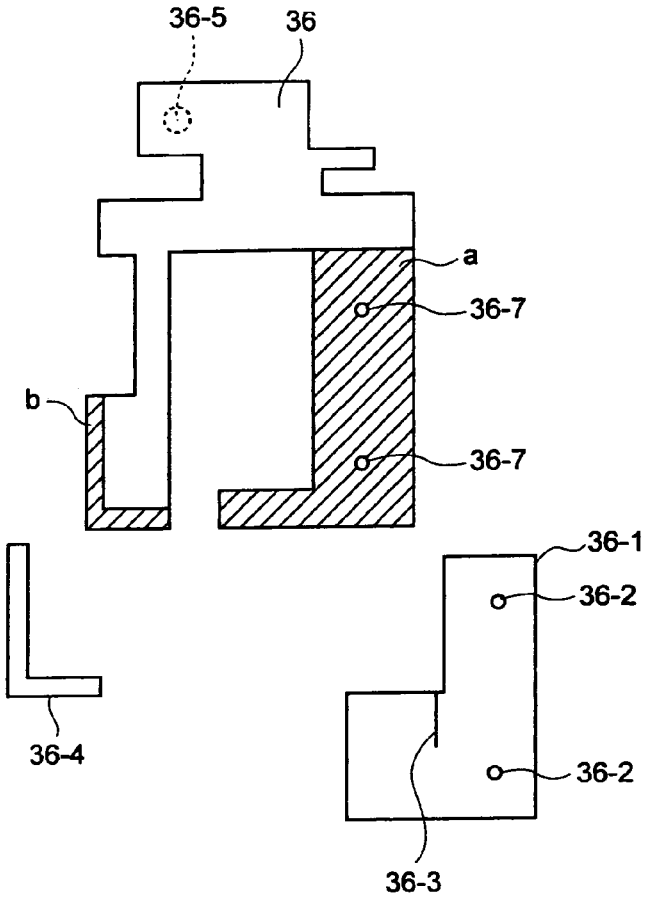
FIG. 6 is an exploded schematic view of the cleaning device.

Next, charger cleaning device 36 of this embodiment will be explained. The constitution of charger cleaning device 36 is shown in FIGS. 5 and 6. As shown in FIG. 6, charger cleaning device 36 is made of insulating resin, for example, polypropylene resin and is composed of a plate-like member having two projections of hatched parts a and b shown in FIG. 6. To hatched part a of the plate, cleaning sheet 36-1 which is a film-shaped elastic member such as Mylar (trademark-of DuPont) sheet or Kapton (trademark of Toray Co., Ltd.) sheet is affixed. In this embodiment, the Kapton sheet is used. Cleaning sheet 36-1 has formed openings 36-2, is positioned by fitting openings 36-2 to projections 36-7 formed on charger cleaning device 36, and by fusing projections 36-7, is prevented more from separation. The thickness of cleaning sheet 36-1 is preferably 10 to 100 μm and particularly desirably 25 to 75 μm. In this embodiment, a one with a thickness of 50 μm is used. Further, when an abrasive material is coated on the cleaning sheet, discharge products can be removed and the effect can be improved more. The bite width of the front end of sawtooth discharge portion 26-1 of sawtooth discharge electrode 26 into the cleaning sheet is desirably 0.1 to 1.5 mm and in this embodiment, the bite width is set to 0.5 mm.

In hatched part b of charger cleaning device 36, shield plate 27 and dust collection member 36-4 making contact with a part of holding plate 37 are installed. Dust collection member 36-4 is installed on both sides of hatched part b across charger cleaning device 36. The material of duct collection member 36-4 is composed of felt, a hair brush, and sponge and the thickness is preferably 0.5 to 3 mm.

Figure 7:
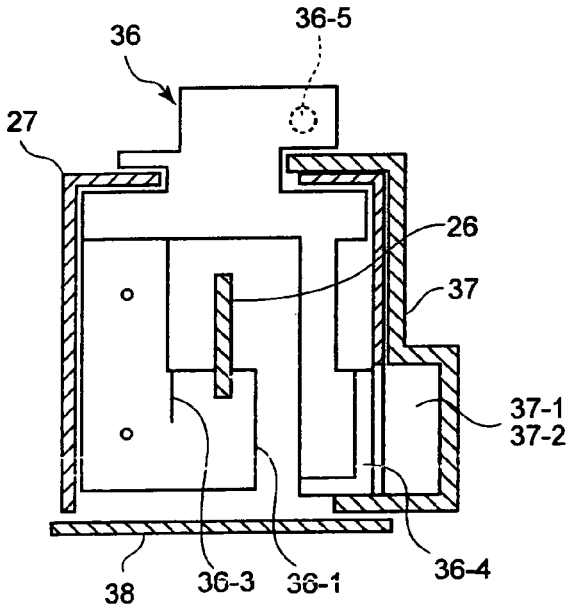
FIG. 7 is a cross sectional view along a line A-A of the charger shown in FIG. 4.

FIG. 7 is a cross sectional view of charger cleaning device 36 with cleaning sheet 36-1 attached to and the charger with dust collection member 36-4 attached to. Further, this cross sectional view indicates section A-A of the charger shown in FIG. 4.

On charger cleaning device 36, to move the plate in the longitudinal direction of sawtooth discharge electrode 26, rod member 36-5 with one end thereof fixed to the plate is installed. Further, on shield plate 27, rod support member 36-6, installed on shield plate 27, for slidably supporting rod member 36-5 via the hole is installed.

Figure 8:
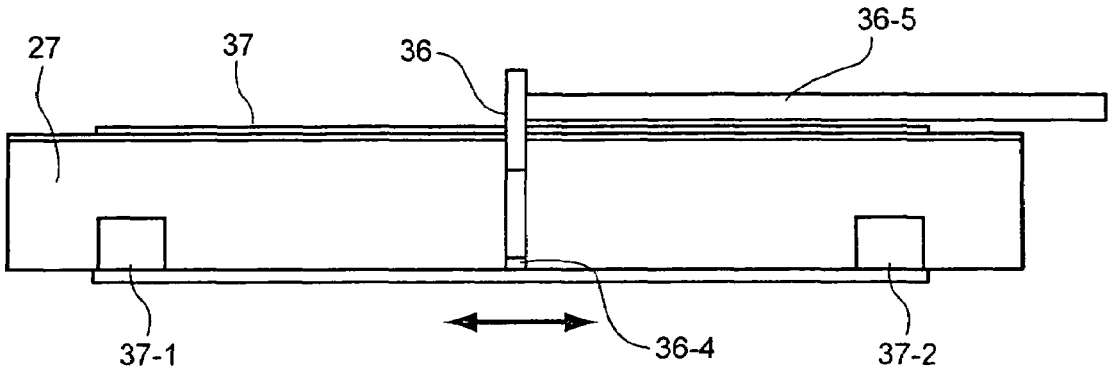
FIG. 8 is a schematic view showing the situation of collecting dust.

Next, the operation of this embodiment will be explained. When the print quality is lowered or at time of periodical cleaning, the cover, not drawn, of main body 1 of the image forming apparatus is opened and rod member 36-5 is moved back and forth in the direction of the arrow shown in FIG. 8, that is, in the longitudinal direction of sawtooth discharge electrode 26. By movement of rod member 36-5, charger cleaning device 36 moves in the longitudinal direction of sawtooth discharge electrode 26 and as shown in FIG. 5, cleaning sheet 36-1 makes contact with the front end of sawtooth discharge portion 26-1 of sawtooth discharge electrode 26 and removes dust. As shown in FIG. 6, insection 36-3 is formed in cleaning sheet 36-1, and cleaning sheet 36-1 is elastic, so that as shown in FIG. 5, when cleaning sheet 36-1 makes contact with the face of front end R of sawtooth discharge portion 26-1, cleaning sheet 36-1 is bent in the opposite direction of the movement direction and when it makes contact next with the front end of sawtooth discharge portion 26-1, in addition to the moving speed of charger cleaning device 36, by the repulsion force of cleaning sheet 36-1, cleaning sheet 36-1 makes contact with sawtooth discharge portion 26-1. By this operation, cleaning sheet 36-1 removes dust while giving vibration to sawtooth discharge portion 26-1. Here, garbage (dust) such as discharge products, toner, and dust is removed from sawtooth discharge portion 26-1 in correspondence to cleaning by charger cleaning device 36, though as described previously, charger 12 is inclined, so that garbage (dust) such as discharge products, toner, and dust falls inside shield plate 27 on the side where holding plate 37 is installed. Conventionally, even if dust falls inside shield plate 27, it is left as it is, so that dust occurring during cleaning is floated (re-scattered) by a wind in the apparatus and is adhered to grid 38, thus an unexpected reduction in the print quality may be caused. In this embodiment, sawtooth discharge electrode 26 is cleaned by charger cleaning device 36 and simultaneously, the fallen dust can be collected and stored in dust collection portions 37-1 and 37-2 installed at both ends of holding plate 37 by dust collection member 36-4. Cleaning device 36, not to disturb discharge during general printing, is stopped on the side of support member 28.

Here, the cleaning effects of the cleaning device of this embodiment are given in Table 1.

TABLE 1

| | Conventional cleaning device | Cleaning device of this embodiment |
|---|---|---|
| Before cleaning | X | X |
| After cleaning | ○ | ○ |
| After passing of 500 sheets after cleaning | Δ | ○ |

X: Irregularities occurred in white ground
Δ: Irregularities occurred in half tone instead of white ground
○: No irregularities When stains such as discharge products, dust, and toner are adhered to the front end of sawtooth discharge portion 26-1 of sawtooth discharge electrode 26 (irregularities occur in the white ground of a printed image), immediately after the front end of sawtooth discharge portion 26-1 of sawtooth discharge electrode 26 is cleaned, an image of the white ground and half tone is obtained and the occurrence condition of image irregularities (discharge irregularities) is confirmed. In both the conventional cleaning device and cleaning device of this embodiment, no image irregularities (discharge irregularities) occur and the cleaning effect for the front end of sawtooth discharge portion 26-1 is not changed. When an image is obtained after passing of 500 sheets after cleaning, in the conventional cleaning device, image irregularities (discharge irregularities) occur in the half tone, while in the cleaning device of this embodiment, no image irregularities occur. When the charger having the conventional cleaning device after passing of 500 sheets is checked, toner and dust are adhered on the grid. The reason is that toner and dust removed from the front end of sawtooth discharge portion 26-1 of sawtooth discharge electrode 26 by cleaning are adhered onto the grid by the flow of wind in the apparatus during cleaning. In the charger having the cleaning device of this embodiment, toner and dust are not adhered onto the grid and the effect of this embodiment is produced sufficiently.

Further, in this embodiment, the cleaning device is moved manually, though an automatic moving method using a motor, a cleaning device position sensor, a cleaning device moving wire, or a cleaning device moving belt can be used. Further, as a discharge electrode of this embodiment, the sawtooth discharge electrode is used. However, a wire-shaped discharge electrode may be used.

According to the present invention, not only the discharge electrode is cleaned but also dust removed by cleaning is collected, thus removed dust can be prevented from scattering again.

What is claimed is:

1. An image forming apparatus comprising:

a photosensitive member;

a charger to charge a surface of the photosensitive member;

an exposure to expose the surface of the photosensitive member charged by the charger, thereby form an electrostatic latent image; and an image forming unit to develop the electrostatic latent image and transfer the developed image, thereby form an image on a medium, wherein the charger includes:

a sawtooth discharge electrode arranged in a longitudinal direction of the photosensitive member;

a shield plate having an opening portion on the surface side of the photosensitive member to cover the sawtooth discharge electrode;

a cleaning member provided with contact to the sawtooth discharge electrode, to move inside the shield plate in a longitudinal direction of the sawtooth discharge electrode, thereby removes dust from the sawtooth discharge electrode, wherein the cleaning member is an elastic material in which an insection is formed near the contact portion with the sawtooth discharge electrode so that it can be bent in the opposite direction of the movement direction when the cleaning member moves; and a dust collecting portion to collect the dust which fell with movement of the cleaning member;

wherein the charger is arranged with a gradient to the photosensitive member.

2. The image forming apparatus according to claim 1, wherein dust collecting portion stores the dust at both ends of the charger by moving the cleaning member back and forth.

3. The image forming apparatus according to claim 1, wherein the cleaning member is made of insulating resin and includes a plate moving in the longitudinal direction of the sawtooth discharge electrode and a film-shaped elastic member attached to the plate to make contact with the sawtooth discharge electrode and remove the dust from the sawtooth discharge electrode.

4. The image forming apparatus according to claim 3, wherein the cleaning device has a rod member one end of which is fixed to the plate to move the plate in the longitudinal direction of the sawtooth discharge electrode.

5. A process cartridge removably attached to a main body of an image forming apparatus, comprising:

a photosensitive member; and a charger to charge a surface of the photosensitive member, wherein the charger includes:

a sawtooth discharge electrode arranged in a longitudinal direction of the photosensitive member;

a shield plate having an opening portion on the surface side of the photosensitive member to covering the sawtooth discharge electrode;

a cleaning member provided with contact to the sawtooth discharge electrode to move inside the shield plate in a longitudinal direction of the sawtooth discharge electrode, thereby removes dust from the sawtooth discharge electrode, wherein the cleaning member is an elastic material in which an insection is formed near the contact portion with the sawtooth discharge electrode so that it can be bent in the opposite direction of the movement direction when the cleaning member moves; and a dust collecting portion to collect the dust which fell with movement of the cleaning member;

wherein the charger is arranged with a gradient to the photosensitive member.

6. The process cartridge according to claim 5, wherein the dust collecting portion stores the dust at both ends of the charger by moving the cleaning member back and forth.

7. The process cartridge according to claim 5, wherein the cleaning member is made of insulating resin and includes a plate moving in the longitudinal direction of the sawtooth discharge electrode and a film-shaped elastic member attached to the plate to make contact with the discharge electrode and remove the dust from the sawtooth discharge electrode.

8. The process cartridge according to claim 7, wherein the cleaning member has a rod member one end of which is fixed to the plate to move the plate in the longitudinal direction of the sawtooth discharge electrode.

9. A charger comprising:

a sawtooth discharge electrode arranged in a longitudinal direction of a photosensitive member;

a shield plate having an opening portion on a surface side of the photosensitive member to cover the sawtooth discharge electrode;

a cleaning member provided with contact to the sawtooth discharge electrode to move inside the shield plate in a longitudinal direction of the sawtooth discharge electrode, thereby removes dust from the sawtooth discharge electrode, wherein the cleaning member is an elastic material in which an insection is formed near the contact portion with the sawtooth discharge electrode so that it can be bent in the opposite direction of the movement direction when the cleaning member moves; and a dust collecting portion to collect the dust which fell with movement of the cleaning member.

10. The charger according to claim 9, wherein the dust collecting portion stores the dust at both ends of the charger by moving the cleaning member back and forth.

11. The charger according to claim 9, wherein the cleaning member is made of insulating resin and includes a plate moving in the longitudinal direction of the sawtooth discharge electrode and a film-shaped elastic member attached to the plate for making contact with the sawtooth discharge electrode and removing the dust from the discharge electrode.

12. The charger according to claim 11, wherein the cleaning member has a rod member one end of which is fixed to the plate to move the plate in the longitudinal direction of the sawtooth discharge electrode.

* * * * *